United States Patent [19]

Sangster

[11] 3,972,648

[45] Aug. 3, 1976

[54] WELL CONTROLLER AND MONITOR

[76] Inventor: Paul B. Sangster, P.O. Box 158, Skellytown, Tex. 79080

[22] Filed: Nov. 29, 1974

[21] Appl. No.: 528,520

Related U.S. Application Data

[63] Continuation of Ser. No. 427,952, Dec. 26, 1973, abandoned.

[52] U.S. Cl. ..... 417/12

[51] Int. Cl.[2] ..... F04B 49/00

[58] Field of Search ..... 73/195; 417/12, 28

[56] References Cited

UNITED STATES PATENTS

| | | | |
|---|---|---|---|
| 1,980,799 | 11/1934 | Hardesty | 417/12 |
| 2,456,456 | 12/1948 | Smith | 417/12 |
| 2,983,907 | 5/1961 | Scouries | 73/195 |
| 3,083,570 | 4/1963 | Truman | 73/195 |
| 3,091,179 | 5/1963 | Echols | 417/12 |
| 3,610,779 | 10/1971 | Hubby | 417/5 |
| 3,854,846 | 12/1974 | Douglas | 417/12 |

*Primary Examiner*—William L. Freeh
*Attorney, Agent, or Firm*—Harold H. Flanders

[57] ABSTRACT

A controller and monitor for a fluid producing well is disclosed which operates on the principle that a transducable signal from a positive displacement meter is utilized to continually reset a time delay device which provides for continuing operation of said well so long as said transducable signal indicative of said well having produced a predetermined quantity of output as measured by said positive displacement meter is received by said time delay device prior to the expiration of a predetermined time interval established within said time delay device.

2 Claims, 2 Drawing Figures

WELL CONTROLLER AND MONITOR

This is a continuation of application Ser. No. 427,952, filed Dec. 26, 1973 now abandoned.

BACKGROUND OF THE INVENTION

In general, the present invention relates to the control and monitoring of fluid output devices. More specifically the present invention relates to the control and monitoring of the output of oil and gas wells.

Dynamometers and pre-set timers have, of course, been employed with various telemetering equipment in the oil and gas fields for some time. However, none of the known systems have the capability of the present system to run a well as long as it is capable of producing at a predetermined production rate, thus maximizing the output possible from a given well while at the same time producing a permanent production record as well as a resettable production record of each of a plurality of wells.

Thus, in large measure the failure of the prior art has been in its failure to recognize the unique advantages of the presently claimed invention and concept which overcomes many of the defects of the prior art as described herein.

SUMMARY OF THE INVENTION

Accordingly, it is an object of the present invention to provide a new, unobvious, and highly effective array of devices, methods, and systems which overcome the deficiencies of the prior art as described above.

It is a further object of the present invention to provide a system which will allow a well to produce so long as its production exceeds a predetermined production rate established for that well.

Another object of the present is to provide a safety backup system in case of a malfuction providing a false indication from the well.

Further, it is an object of the present invention to allow the well a substantially uninterrupted rest period for recovery of its production capacity to the predetermined rate when the output of the well falls below the predetermined rate.

Another object of the present invention is to provide a permanent production record of each of a plurality of wells.

It is also an object of the present invention to provide a resettable production record of the output of each of a plurality of wells.

Additionally, it is an object of the present invention to provide for the monitoring of the production of each of a plurality of wells at a remote, easily establishable and removable site.

Other objects and a fuller understanding of the present invention may be had by referring to the following description and claims taken in conjunction with the accompanying drawings.

The present invention overcomes the deficiencies of the prior art and achieves its objectives by providing a control and monitoring system which operates on the principle that a transducable signal from a positive displacement meter is utilized to continually reset a time delay device which provides for the continuing operation of said well so long as said transducable signal indicative of said well having produced a predetermined quantity of output as measured by said positive displacement meter is received by said time delay device prior to the expiration of a predetermined time interval established by and for the control of a said time delay device. When the above conditions are not met, the system switches the well to a predetermined rest period following which a single predetermined interval of production is undertaken to determine if the well is again capable of producing at the predetermined rate. If the well is capable of producing at the predetermined rate, the system continues operation as described above until the production rate falls below the predetermined production rate. If the well in the test cycle fails to perform at the predetermined rate, the well is returned to the reset cycle for another round of the above-described sequence of events.

BRIEF DESCRIPTION OF THE DRAWINGS

In order to facilitate the understanding of the present invention, reference will now be made to the appended drawings of preferred embodiments of the present invention. The drawings should not be construed as limiting the invention but are exemplary only. In the drawings.

DESCRIPTION OF THE PREFERRED EMBODIMENTS

Figures 1, 2:
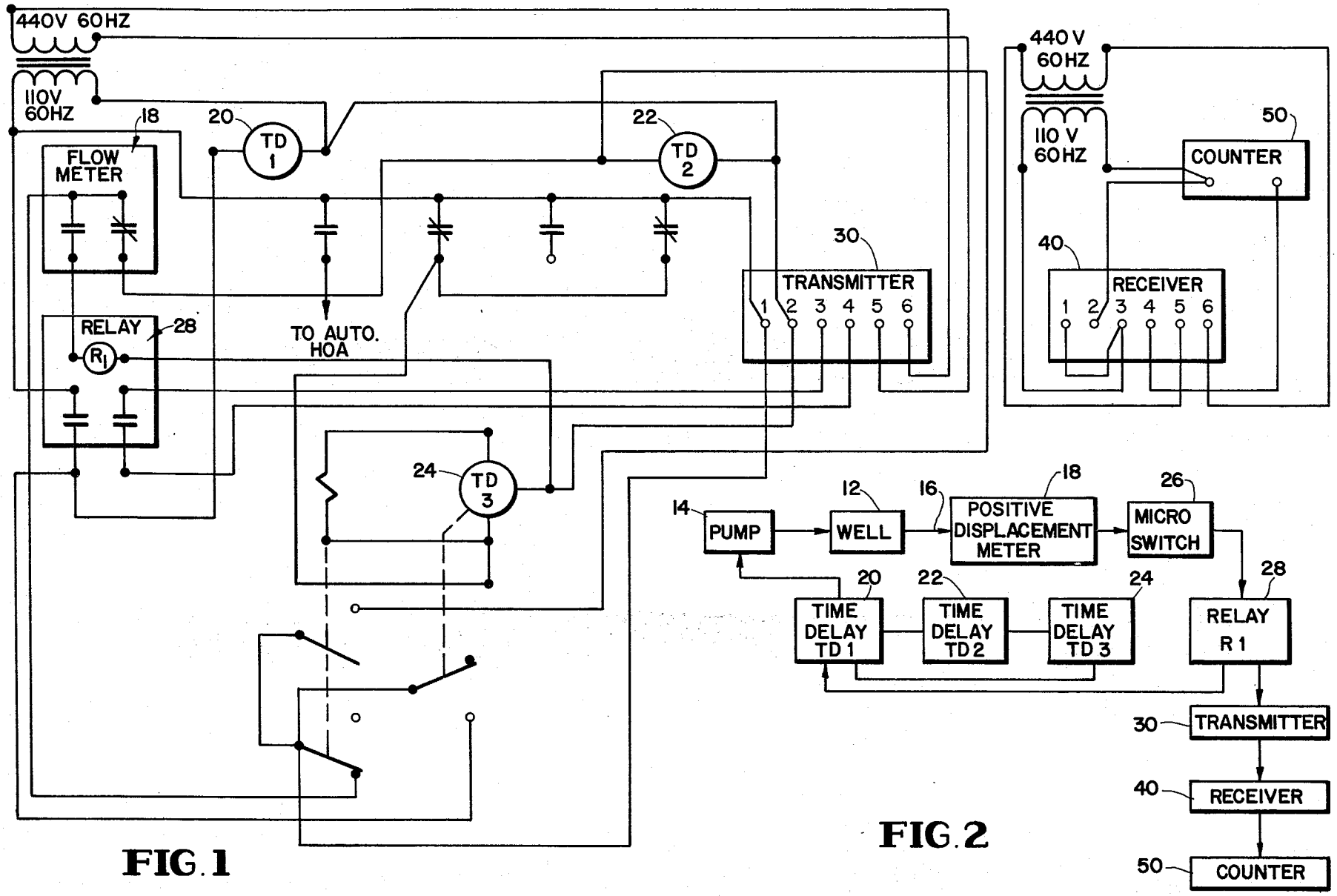
FIG. 1 is a schematic diagram representative of the present invention.
FIG. 2 is a functional block diagram of the present invention.

The purpose of the controller and of the control and monitoring system disclosed herein, primarily, is to run a well as long as its production exceeds a rate with reference to the time set on a first time delay device. A second time delay device's sole purpose is as a safety in the event that the flowmeter stops with the contacts to the first time delay device closed. In this event, the second time delay device will time out and put the well in a rest period. When the production of the well falls below the pre-set time of the first time delay device, it will transfer to a third time delay device for its prescribed rest period of a predetermined interval.

The secondary purpose of this controller is for a permanent production record as well as a resettable production record. The permanent record is achieved from a positive displacement meter. The resettable record is achieved by a first relay which has a dual purpose. This said first relay is energized by a micro switch on said positive displacement meter. When this first relay energizes, it resets the first time delay device and triggers the transmitter which sends a pulse over the high voltage (usually 440 V.) line to a distant point where a receiver picks up the signal and closes a relay which counts the units of production. This counter is resettable.

The purpose of the controller of FIG. 1, primarily, is to run a well as long as its production exceeds the time set on TD1. TD2's sole purpose is as a safety in the event the flow meter stops with the contacts to TD1 closed. In this event TD2 will time out and put the well in a rest period. When the production falls below the pre-set time of TD1, it will transfer to TD3 for its prescribed rest period.

The secondary purpose of this controller is for a permanent production record as well as a resettable production record. The permanent record is achieved from the positive displacement meter. The resettable record is achieved by R1 relay which has a dual purpose. R1 relay is energized by the micro switch on the positive displacement meter. When R1 energizes, it resets TD1 and triggers the transmitter which sends a pulse over the high voltage (usually 440V.) line to a distant point where a receiver picks up the signal and closes a relay which counts the units of production which is resettable.

As shown in FIG. 2, oil or gas well, 12, with a pump, 14, in operation may produce a given output of oil, gas, etc. 16. This output may be measured by any suitable positive displacement meter, 18. The well, 12, will continue to be pumped by pump 14 so long as a time delay device such as TD1, designated 20, allows the supply of power to pump, 14.

In the event that a malfunction occurs such that time delay device 20 would allow the pump to operate notwithstanding the lack of output a second time delay device TD2, designated 22 will at the expiration of a predetermined time interval switch the pump, 14, and well, 12, to a prescribed and predetermined interval for a rest period as established by a third time delay device TD3, designated 24.

When the positive displacement meter 18 measures an output from well, 12, it may provide by a flow meter a permanent, cumulative production record of the output of well, 12.

The positive displacement meter 18 as it measures the output from the well, 12, may also be energizing a micro switch 26, energize relay R1 designated 28.

Relay 28 serves a dual function, namely: When relay (R1) 28 is energized, it resets time delay device (TD1) 28 which allows the pump 14 to continue pumping well 12, and when relay (R1) 28 energizes, it triggers the transmitter, 30.

Transmitter, 30, then sends a pulse over the high voltage line, typically 440 or 480 volts, to a distant point where a receiver, 40, picks up the signal and closes a relay in counter 50 which counts the units of production and which may be resettable.

So long as relay (R1) 28 is energized by receiving in a given time period, the output from micro switch 26 and positive displacement meter 18, it (i.e.: relay [R1] 28 will continue to reset time delay device (TD1) 20 and thus allow the continued operation of pump 14 and well 12.

If a reset signal from relay (R1) 28 is not received at time delay device (TD1) 20 before the expiration of the preset and predetermined time period, the power to pump 14 is removed and time delay device (TD3) begins the timing of a prescribed and predetermined reset period during which the well is not pumped.

By thus selecting to pump only when the well is capable of producing at a predetermined level, it is possible to maximize product of the well at the minimum or a reduced cost on electricity utilized for production from the well.

When the power is first turned on, a rest period of say, for purposes of example, 2 minutes is begun. Power is then applied to pump 14 through time delay device (TD1) 20 for a period of time say on the order of 40 seconds.

If no production is achieved or if the production achieved is at a rate below that required to keep time delay device (TD1) 20 reset, the system switches back to its rest period for an additional 2 minutes.

If the output is produced at a given predetermined low rate which exceeds the rate of delay on time delay device (TD1) 20, the pump 14 will continue to operate and pump.

When the flow rate drops below the rate necessary to reset time delay device (TD1) 20, the control is switched to time delay (TD3) 24.

Each well will or may require different timing both on the production cycle and on the rest cycle. Basically the required amount of time will depend on the amount of time required of a given well to produce a certain predetermined fractional part of a barrel of oil, etc.

Any suitable pump may be used if it is electrically controlled.

A FLOCO meter has been found satisfactory but any positive displacement meter capable of producing an electrical pulse output to activate relay (R1), 28, may be employed.

Any suitable time delay mechanical or electrical may be utilized. For example, time delay devices such as are shown in U.S. Pat. Nos. 2,489,381; 2,627,919; 2,981,533 and 3,185,786 have been found satisfactory as time delays (TD1) 20 and (TD2) 22 as have the time delay on drop out relays of Series 7000 of the Agastat Division of Amerace-Esna Corporation of Elizabeth, New Jersey.

Timers such as shown in U.S. Pat. No. 3,054,023 and produced as Cycl-Flex Timers by Eagle Signal have been found saitsfactory as a time delay mechanism at TD3 or time delay 24.

A suitable counter has been found to be of the type produced by Eagle Signal Company but any pulse triggered timer may be employed.

Any suitable relay of the type shown in FIG. 1 may be employed.

Any suitable transmitter and receiver compatible with each other may be employed; however, in order that a large number of wells may be monitored at a remote site, it is desirable to utilize a multiple frequency transmitter-receiver with each well being assigned a separate frequency.

In all cases within the present invention electrical, electronic and/or pneumatic-mechanical detection, switching and time delay devices may be substitued for one another without departing from the scope or intent of the present invention. Although a specific preferred embodiment of the present invention has been described in detailed description above, the description is not intended to limit the invention to the particular forms or embodiments disclosed herein, since they are to be recognized as illustrative rather than restrictive and it will be obvious to those skilled in the art that the invention is not so limited. The invention declared to cover all changes and modifications of the specific examples of the invention herein disclosed for purposes of illustration, which do not constitute departures from the spirit and scope of the invention.

What is claimed is:

1. A control and monitoring system for oil and gas wells comprising:

a. pump means for producing, when in operation, an output from a well;

b. a positive displacement meter measuring the output of a well;

c. time delay device means;

d. signal source means responsive to said measured output of a well as measured by said positive displacement meter for producing a transduceable signal from said positive displacement meter for resetting said time delay device means;

e. means for energizing a relay device in response to said signal to send a reset signal to said time delay device means;

f. means to continually and repeatedly reset said time delay device means, so long as, and if and only if, said reset signal is received from said relay device in response to said signal received from the said positive displacement meter measuring the output of said well within and prior to the expiration of a predetermined time interval established within said time delay device means;

g. said time delay device means further including means switching said well to a rest cycle in which the said pump means are shut off for a predetermined period of time in the absence of receiving said reset signal within the said predetermined time interval; and h. said time delay device means additionally including means for returning the well to an operational condition for so long as said time delay device means continues to be reset following said predetermined period of time during which the said pump means are shut off.

2. The control and monitoring system for oil and gas wells of claim 1 further including means for energizing a relay device in response to said signal representative of the measured output of a well to provide for the triggering of the transmission of a signal for counting the units of production to a remote point and means at said remote point for counting the same.

* * * * *